US005377591A

United States Patent [19]

Lippold et al.

[11] Patent Number: 5,377,591

[45] Date of Patent: Jan. 3, 1995

[54] WASHING APPARATUS FOR PRINTING PRESS CYLINDERS HAVING A SPRING-BAND FREEWHEEL TENSIONING DEVICE

[75] Inventors: Andreas Lippold, Nidderau; Marco Bergmann, Offenbach am Main, both of Germany

[73] Assignee: Man Roland Druckmaschinen AG, Germany

[21] Appl. No.: 199,908

[22] Filed: Feb. 22, 1994

[30] Foreign Application Priority Data

Feb. 19, 1993 [DE] Germany ..... 4305153

[51] Int. Cl.[6] ..... B41F 35/00

[52] U.S. Cl. ..... 101/423; 101/425; 192/8 C; 15/256.51

[58] Field of Search ..... 101/423, 425, 416.1; 192/8 C; 188/82.6, 82.7, 82.77; 198/498; 15/99, 228, 256.51

[56] References Cited

U.S. PATENT DOCUMENTS

| | | | |
|---|---|---|---|
| 3,452,840 | 7/1969 | Cain | 188/82.77 |
| 3,837,441 | 9/1974 | Uno et al. | 192/8 C |
| 4,135,448 | 1/1979 | Moestue | 101/425 |
| 4,986,182 | 1/1991 | Sawaguchi et al. | 101/425 |
| 5,009,161 | 4/1991 | Wirz | 101/425 |
| 5,287,949 | 2/1994 | Kitamura | 188/82.6 |
| 5,328,007 | 7/1994 | Yokozuka et al. | 192/8 C |

FOREIGN PATENT DOCUMENTS

| | | |
|---|---|---|
| 0479403A2 | 4/1992 | European Pat. Off. . |
| 2538067A1 | 4/1976 | Germany . |
| 3005469C2 | 7/1987 | Germany . |

*Primary Examiner*—Edgar S. Burr
*Assistant Examiner*—Lynn D. Hendrickson
*Attorney, Agent, or Firm*—Leydig, Voit & Mayer, Ltd.

[57] ABSTRACT

A washing apparatus for cleaning the surface of cylinders in a printing machine includes a fresh-cloth roller, a washing roller and a dirty-cloth roller. A washing cloth is transported from the fresh-cloth roller via the washing roller to the dirty-cloth roller. A spring-band freewheel in the form of a helical coil spring is wound non-positively on the shaft of the fresh-cloth roller. The spring-band freewheel free-wheels during the rotation of the shaft in the direction of tension applied to the washing cloth and blocks the shaft from rotating in the opposite direction. The necessary cloth tension is guaranteed, at the same time, by means of the resilient effect of the spring-band freewheel.

5 Claims, 2 Drawing Sheets

WASHING APPARATUS FOR PRINTING PRESS CYLINDERS HAVING A SPRING-BAND FREEWHEEL TENSIONING DEVICE

FIELD OF THE INVENTION

The present invention relates generally to a washing apparatus for cleaning the surface of cylinders in a printing press and more particularly concerns a device for regulating the tension on a washing cloth in such an apparatus.

BACKGROUND OF THE INVENTION

A washing apparatus for cleaning the surface of printing press cylinders usually includes a fresh-cloth supply roller and a dirty-cloth take-up roller for receiving a washing cloth which is impregnated with washing fluid and which is drawn off from the fresh-cloth supply roller and wound up on the dirty-cloth take-up roller. In order to press the washing cloth onto the cylinder, a press-on element, for example a washing roller or a diaphragm part loadable with compressed air, is preferably arranged between the two cloth supply/take-up rollers. The washing cloth is at the same time always to be held under tension, since otherwise it sags, forms loops or can be drawn into the printing machine.

A washing apparatus of this general type is known, for example, from DE 3,005,469 C2. As disclosed here, the winding roller (dirty-cloth take-up roller) draws off the washing cloth from the fresh-cloth supply roller in steps via a ball drive, draft shaft and one-way coupling.

Furthermore, EP 0,479,403 A2 discloses a washing cloth feed which is intended to prevent the washing cloth from folding up or sagging. The washing cloth feed is controlled by means of a spring element and braking device. A helical spring is arranged as a spring element at one end on a sleeve, looping concentrically and frictionally around the fresh-cloth roller shaft, and is fastened at the other end to a fixed support. During the transport of the washing cloth, the spring is stretched a specific amount and thereby prevents the washing cloth from forming folds or from sagging. A brake jaw engages on the shaft of the fresh-cloth roller and controls the cloth feed.

These known prior art devices are disadvantageous in that a large number of components is necessary in order to control the tension and the transport of the washing cloth.

OBJECTS AND SUMMARY OF THE INVENTION

The primary object of the invention is to provide a simple and reliable device for applying tension to a fresh-cloth supply roller in the unwind direction and to block rotation thereof in the opposite direction.

According to the invention, this is achieved by providing a spring-band freewheel including a helical spring having a coil portion and first and second ends, with the coil portion disposed in close-fitting concentric relation on one end of the fresh-cloth supply roller shaft and the first spring end free. The second spring end projects from the shaft substantially tangent to the direction of unwinding rotation thereof and is fixed to the supporting frame whereby the coil portion of the spring-band freewheel loosens from the shaft during rotation of the shaft in the fresh-cloth supply direction and seizes onto the shaft incident to rotation of the shaft in the opposite direction. The coil portion preferably has multiple coil turns.

The solution according to the invention has a low breakaway torque, that is to say the transition from holding friction (starting/static friction) to sliding friction (rotating friction) takes place uniformly rather than abruptly. During starting, the sliding friction speed, commencing from zero, increases continuously. This means that the washing cloth does not form any loops or does not sag during transport. Tearing of the washing cloth, "seizure" of the fresh-cloth roller and stick/-slip movements are avoided.

Pursuant to the invention the spring-band freewheel generates the necessary washing cloth tension as a result of its resilience. The solution according to the invention is operationally viable and does not require a large number of components. If need be, the shaft of the fresh-cloth roller can have a hardened or coated surface in the looping-round region of the spring-band freewheel. Alternatively, the use of a bushing connected to the shaft is also possible. A torque is transmitted only in the direction of tension of the washing cloth in which the spring-band free-wheels, and is blocked in the opposite direction (the at rest position of the shaft of the fresh-cloth supply roller).

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
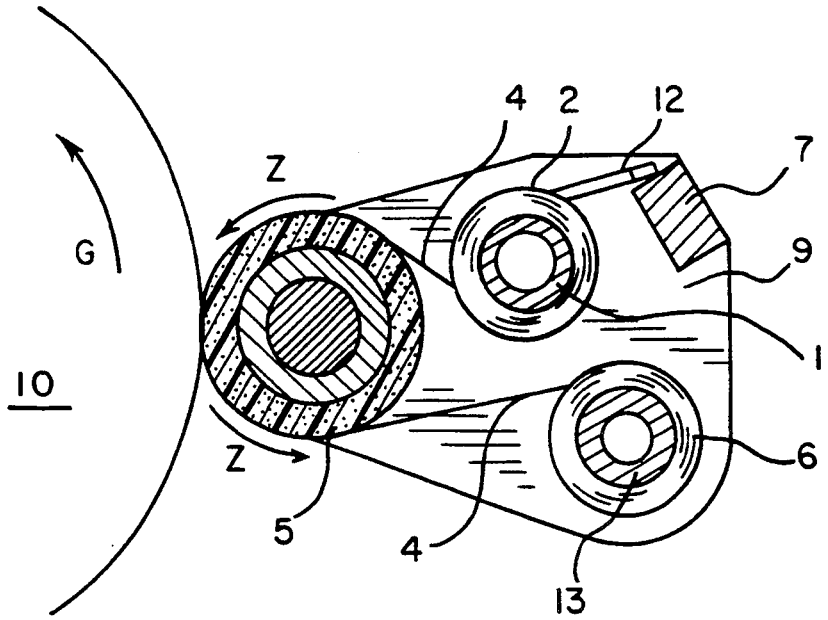
FIG. 1 shows a side view of the washing appliance in section, substantially as seen along line 1—1 of FIG. 2.
Figure 2:
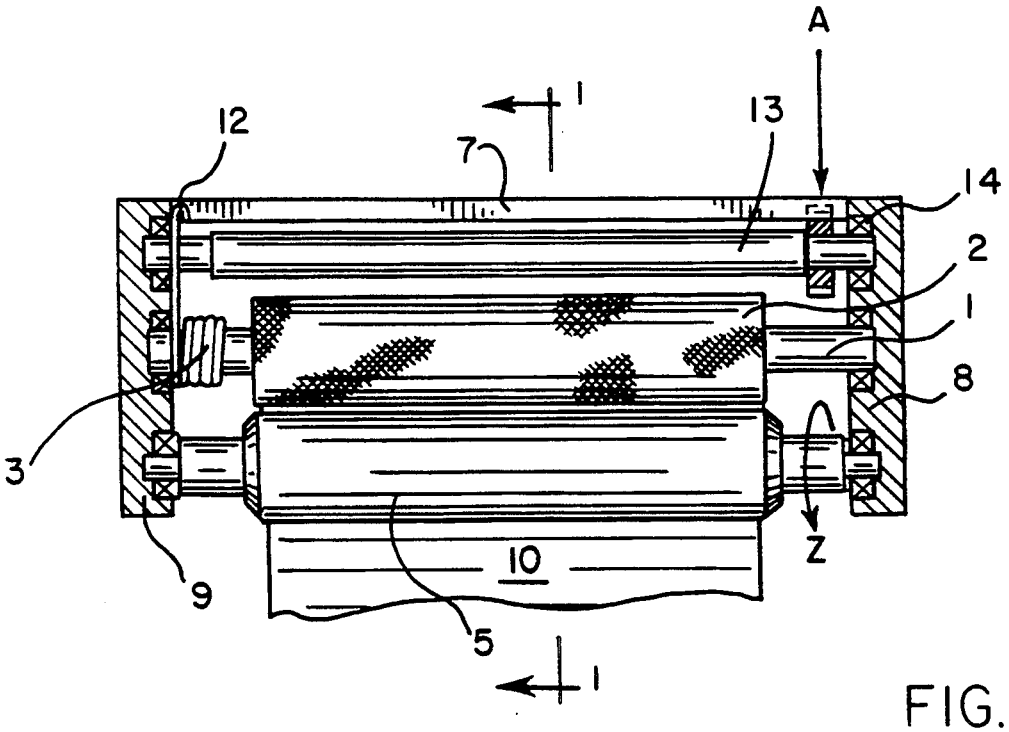
FIG. 2 shows a top view of a washing appliance, without a washing cloth, and with the supporting side frames in section.
Figure 3:
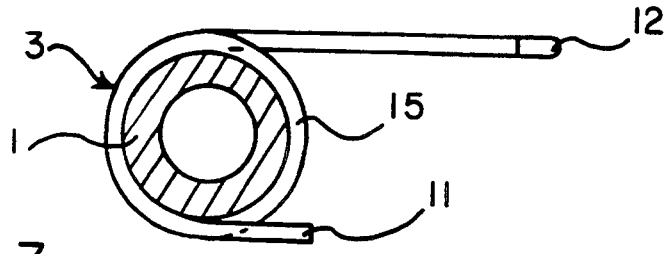
FIG. 3 shows a side view of a spring-band freewheel of the present invention.
Figure 4:
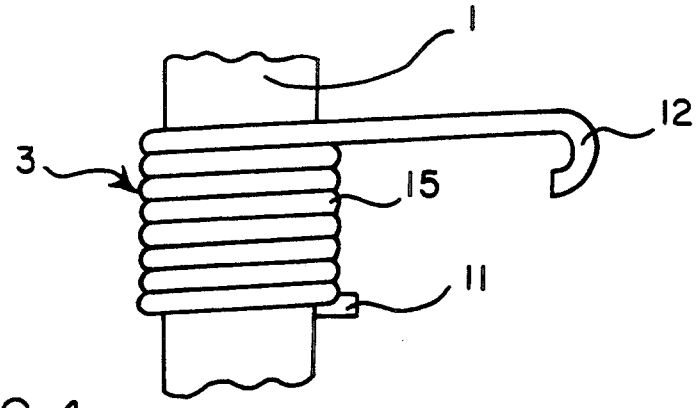
FIG. 4 shows a top plan view of the spring-band freewheel of FIG. 3.

A washing apparatus for rotary printing machines is illustrated somewhat schematically in FIGS. 1 and 2 and is described below. The only represented part of the printing machine is a cylindrical body 10, for example a rubber-blanket cylinder. The washing appliance is designed as a push-in system and, in the installed state, is engageable with the cylindrical body 10 designed as a rubber blanket cylinder. The washing appliance is brought into or out of contact with the rubber blanket cylinder 10 via a conventional throw-on device, which is not illustrated and will not be described any further. A conventional washing fluid feed is also assigned to the washing apparatus and fixed relative to the machine and it is not described in any more detail in the present example.

The washing apparatus consists essentially of two side frame parts 8 and 9 arranged parallel to one another and in which a fresh-cloth supply roller 2, a washing roller 5 and a dirty-cloth take-up roller 6 are journalled for rotation. The fresh-cloth roller 2 serves as a supply roller and possesses a shaft 1 which receives the particular supply of washing cloth 4. The washing roller 5 consists of a shaft which has an elastic coating and serves as a press on element in order to press the washing cloth 4 onto the cylindrical body 10 and at the same time to guide the washing cloth 4. The dirty-cloth roller 6 serves as a take-up or winding roller for the soiled washing cloth 4 and possesses a shaft 13 which can be driven intermittently . The side frame parts 8 and 9 are connected to one another such as by a cross member 7. The washing cloth 4 is guided from the fresh-cloth supply roller 2 in as large a looping round angle as possible over the washing roller 5 in the direction of tension Z of the dirty-cloth take-up roller 6.

In accordance with the invention, a spring-band freewheel 3 is arranged on an exposed end of the shaft 1 of the fresh-cloth supply roller 2 between the bearing point in the associated side frame part, for example item 9, and the supply of washing cloth 4. In the present example, the spring-band freewheel 3 consists of a helical spring having a coil potion 15 and first and second ends 11 and 12. The coil portion 15 has at least one and preferably a plurality of coil turns wound concentrically and non-positively around the shaft 1. The first end 11 of the spring is free. The other spring end 12 is supported on a fixed frame part, for example 15 the cross member 7. The winding direction of the helical coil spring is designed such that the inside diameter of the coil portion increases during the rotation of the shaft 1 in the direction of tension Z.

When it is necessary to clean the cylinder 10, for example the rubber-blanket cylinder, the latter is driven in the opposite direction of rotation as indicated by arrow G. The spring-band freewheel 3 designed as a helical coil spring loops non-positively around the shaft 1 of the fresh-cloth supply roller 2 and, by frictional connection, seizes the shaft 1 incident to rotation in the direction opposite to the direction of tension arrow Z. The washing cloth 4 is wetted via a washing fluid feed (not shown). A suitable drive means indicated at A is provided to rotate the dirty-cloth take-up roller 6 via the shaft 13 and a gearwheel 14. The dirty-cloth take-up roller 6 is operated intermittently and draws off the washing cloth 4 from the fresh-cloth supply roller 2, in the direction of tension Z and receives the washing cloth 4 on the shaft 13, via the washing roller 5 which brings the washing cloth 4 into contact with the cylinder 10 to be cleaned. At the same time, the helical coil spring is opened as a result of the transport of the washing cloth 4 in the direction of tension Z brought about by the shaft 13. The inside diameter of the coil portion 15 of the spring is increased during the rotation of the shaft 1, since the end 12 is fixed. When the transport of the washing cloth 4 has ended, the tensile stress on the washing cloth abates, so that the moment of friction of the spring-band freewheel 3 increases until the shaft is held stationary (locking position) by the coil portion 15 seizing the shaft.

The solution according to the invention is not restricted to the particular embodiment illustrated. Thus, for example, the spring end 12 of the spring-band freewheel 3 can be supported on an adjacent side part 8, 9 or on an adjacent shaft, such as, for example, that of the dirty-cloth take-up roller 6. The coil turns of the spring-band freewheel 3 preferably have a circular or rectangular cross-section. The surface of the shaft 1 can have a wear resistant coating in the region of the spring band freewheel 3. Alternatively, a bushing (not shown) can be fixed to the shaft 1 to support the helically wound coil portion 15 of the spring-band freewheel 3.

We claim as our invention:

1. In a washing apparatus employing a washing fluid and a washing cloth for washing a cylinder in a printing press wherein the washing apparatus includes a fresh-cloth supply roller, a dirty-cloth take-up roller and an intermediate washing roller with each of the rollers having a shaft journalled at its opposite ends in supporting frame parts, the washing cloth being drawn off the fresh-cloth supply roller and around the washing roller by tension resulting from winding the cloth onto the dirty-cloth take-up roller, and throw-on means for selectively causing the washing cylinder to press the washing cloth onto the surface of the cylinder, the improvement comprising a spring-band freewheel including a helical spring having a coil portion and first and second ends, said coil portion being disposed in close-fitting concentric relation on one end of said fresh-cloth supply roller shaft with said first spring end free and said second spring end projecting from said shaft substantially tangent to the direction of unwinding rotation thereof and fixed to one of said supporting frame parts whereby said coil portion of said spring-band freewheel loosens from said shaft during rotation of said shaft in the fresh-cloth supply direction and seizes onto said shaft incident to rotation of said shaft in the opposite direction.

2. A washing apparatus according to claim 1 wherein said coil portion of said spring-band freewheel has multiple coil turns wound concentrically around said shaft end.

3. A washing apparatus according to claim 2 wherein said coil portion of said spring-band freewheel is disposed concentrically about said shaft end between said clean cloth and said supporting frame part journalling said shaft end.

4. A washing apparatus according to claim 1 wherein said coil portion of said spring-band freewheel has at least one coil turn wound concentrically about said shaft end and said coil turn is circular in cross-section.

5. A washing apparatus according to claim 1 wherein said coil portion of said spring-band freewheel has at least one coil turn wound concentrically about said shaft end and said coil turn is rectangular in cross-section.

* * * * *